United States Patent [19]

Bisson et al.

[11] Patent Number: 4,819,573

[45] Date of Patent: Apr. 11, 1989

[54] ELECTRONIC SEWING MACHINE

[75] Inventors: Flavio Bisson, Cava Manara; Giacomo Cattaneo, Pavia; Domenico Peiretti, Turin, all of Italy

[73] Assignee: Necchi Societa per Azioni, Pavia, Italy

[21] Appl. No.: 122,690

[22] Filed: Nov. 19, 1987

[30] Foreign Application Priority Data

Nov. 20, 1986 [IT] Italy ..... 42916 A/86

[51] Int. Cl.[4] ..... D05B 3/02

[52] U.S. Cl. ..... 112/454; 112/445

[58] Field of Search ..... 112/454, 457, 458, 453, 112/121.11, 121.12, 445, 456

[56] References Cited

U.S. PATENT DOCUMENTS

| | | | |
|---|---|---|---|
| 4,499,836 | 2/1985 | Meier et al. | 112/454 X |
| 4,607,585 | 8/1986 | Meier | 112/454 |
| 4,610,211 | 9/1986 | Makabe et al. | 112/454 X |

*Primary Examiner*—Peter Nerbun

*Attorney, Agent, or Firm*—Stevens, Davis, Miller & Mosher

[57] ABSTRACT

In a electronic sewing machine a keyboard and a display are provided, operatively connected to a microprocessor, and adapted to permit, in a simple way, the setting of pattern series and of corresponding sewing parameters, as well as the modification, correction, inputting or erasion of one or more patterns of the same pattern series.

20 Claims, 4 Drawing Sheets

ELECTRONIC SEWING MACHINE

DISCLOSURE OF THE INVENTION

The present invention relates to an electronic sewing machine comprising a keyboard and a display for writing and reading various sewing data.

In sophisticated machines of this known type, the composition and the storing of one or more pattern series and of the sewing parameters of the same paterns such as the pattern width, the stitch length and so on are provided. Also, there is provided the displaying of a pattern at the time of the pattern series, as well as its parameters. This represents appreciable progress in the specific field, increasing further the performance of the electronic sewing machines.

However, it has to be remarked that the composition and displaying system of these machines presents some drawbacks, which minimize their operative efficiency.

In particular, the modification and the correction of one or more patterns of a pattern series and of the corresponding parameters are very difficult and the same is true for inputting or erasing one or more patterns of the same pattern series.

In fact, for operating on one of the patterns of the series and on the corresponding parameters, all the patterns and the corresponding parameters, which follow the considered pattern, must be erased. As a consequence of this, the operator must memorize, for example, on a sheet of paper, such subsequent patterns and corresponding parameters, for inputting them again in the suitable memory of the machine by means of the keyboard when he has operated on the pattern in question and on the corresponding parameters.

It is clear that this operating system is very difficult for the operator, particularly when the series of the pattern is long and when the operations of modification, correction, inputting and erasing are numerous.

It is further noted that the visual information of a single pattern at the same time as with the corresponding parameters makes the situation worse, as it does not permit the operator to visualize either the total or the partial, of the pattern series with the corresponding parameters.

Therefore, it is an object of the present invention to overcome the above described drawbacks. A further object is to provide an electronic sewing machine comprising a keyboard, a display unit, a microprocessor unit connected to the keyboard and to the display unit and further connected to a first memory unit containing data corresponding to a pattern series and to a second memory unit for storing data of patterns displayed in the display unit, the keyboard comprising keys for recovering on the display unit, the alphanumeric type shaped patterns contained in the first memory unit, keys for setting the sewing parameters of the recovered patterns, a key for storing in the second memory unit the recovered patterns and the corresponding sewing parameters, the display unit comprising a first subsequent zone and a second subsequent zone along which the series of the set patterns slide and a third zone in which the sewing parameters are displayed, the first zone being moreover provided for displaying the pattern to be set, the pattern in the phase of sewing, and the pattern on which operations are to be effected, the parameters of the pattern displayed in said first zone being in the meantime displayed in the third zone, while in the second zone the remaining patterns of the pattern series are being displayed, the remaining patterns and corresponding parameters persisting in the second memory unit during the operations on the above mentioned selected pattern.

Other details and features of the invention will stand out from the description given below by way of non-limitative example and with reference to the accompanying drawings, in which.

Figure 1:
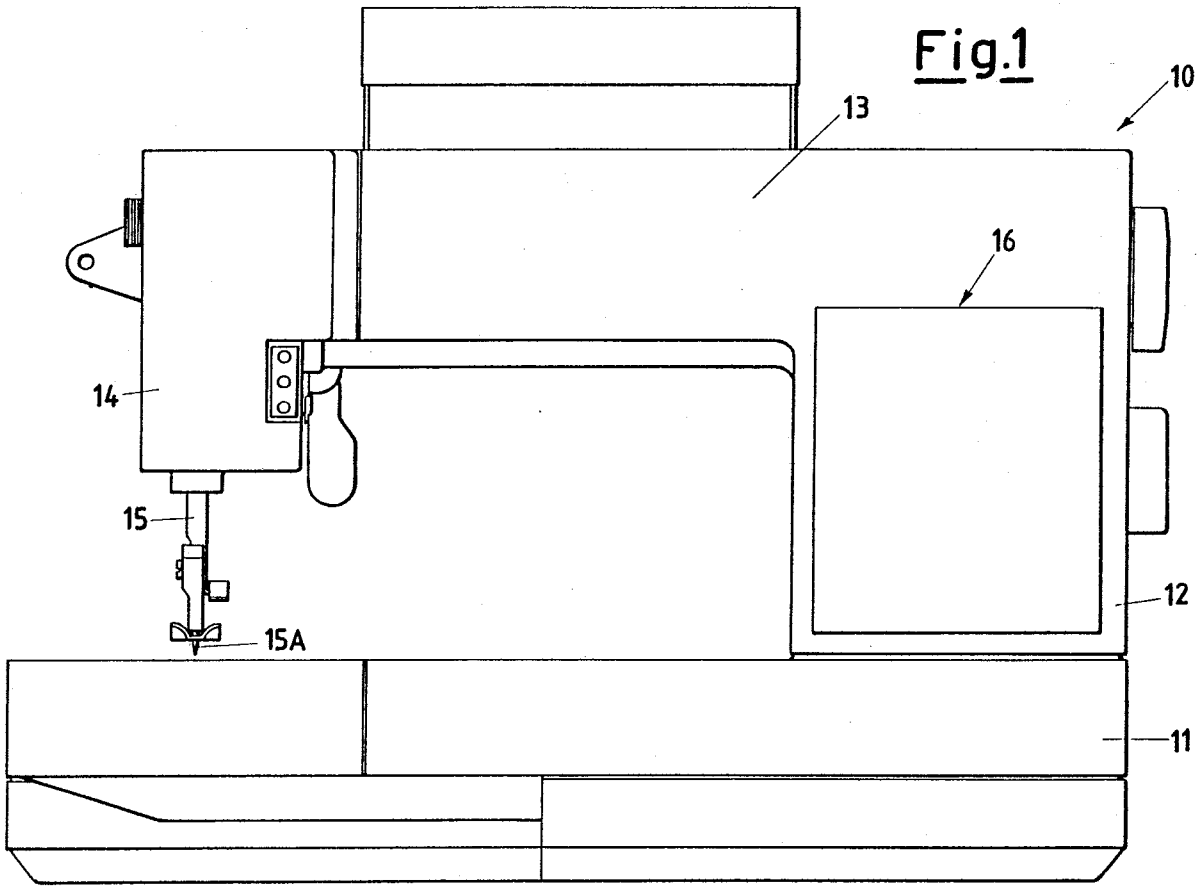
FIG. 1 is a front elevational view of a sewing machine according to the invention.
Figure 2:
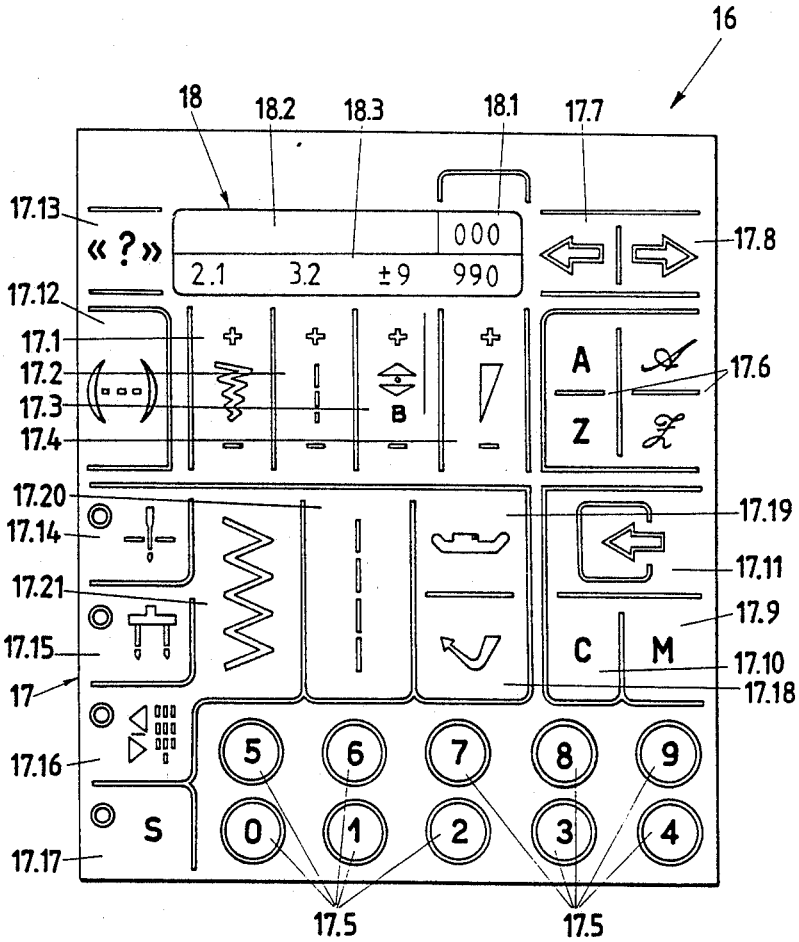
FIG. 2 shows the keyboard and the display of the sewing machine of FIG. 1.

In FIG. 1 the sewing machine is generally indicated as 10, with a casing presenting a bed 11 from which a standard 12 laterally rises, from which, in turn, a bracket arm 13 extends with a terminal head 14 supporting the sewing elements: needle bar 15 and needle 15A. In the standard 12 there is inserted a control board 16 comprising a keyboard 17 and a display unit 18, shown in detail in FIG. 2.

Figure 3:
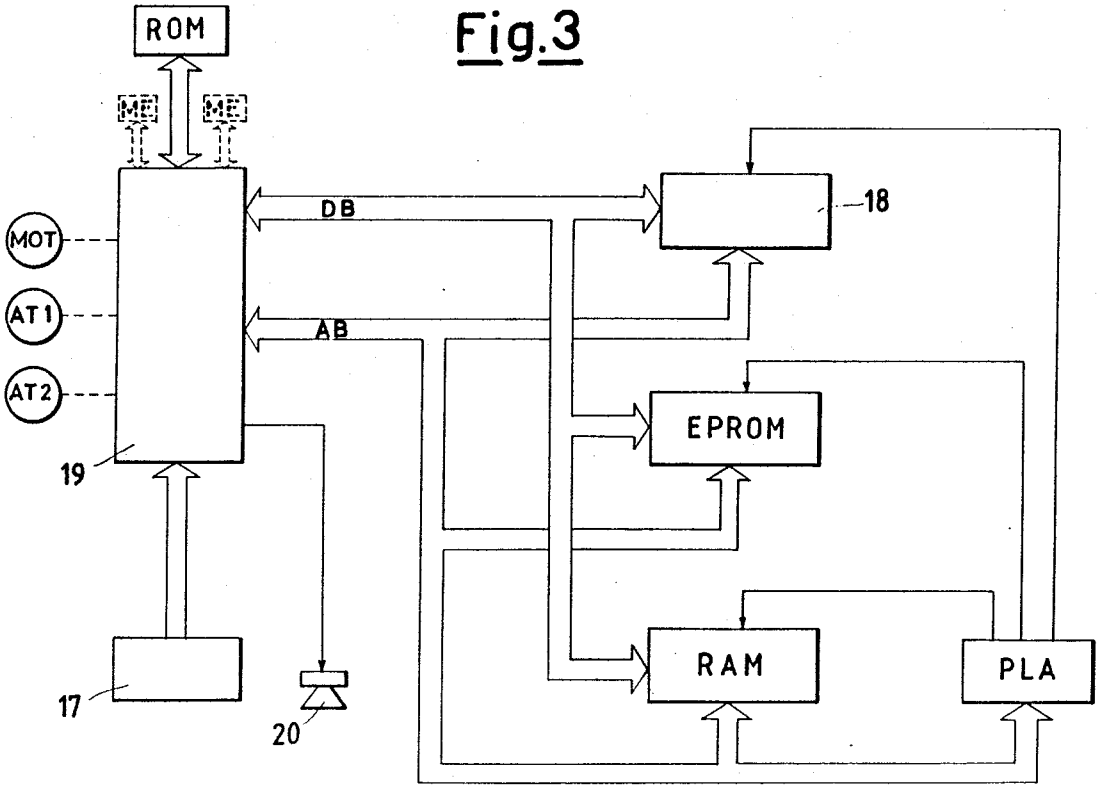
FIG. 3 is a schematic of an electronic circuit of the sewing machine of FIG. 1.

The keyboard 17 and the display unit 18 are connected to an electronic circuit internal to the machine 10, illustrated in FIG. 3, which comprises a microprocessor 19, an EPROM memory unit, a ROM memory unit, a RAM memory unit, and a PLA programable logic network. The microprocessor 19 also is connected via D/A converters and amplifiers not illustrated, to the main motor, indicated by MOT, of the machine 10, which drives the needle 15A and the work feeding device. The microprocessor 19 moreover is connected to two actuators, indicated with AT1 and AT2, which regulate respectively the magnitude of the bight of the needle bar 15 and the stroke length of the feeding device.

The display 18 is of the liquid-crystal type, with two lines of sixteen types each, with internal type generator. Such a display is divided into three zones: two subsequent upper zones 18.1 and 18.2, in which the pattern sequence is displayed and a lower zone 18.3, in which the sewing parameters are displayed. The area 18.1, which will be defined operative, has particular functions which will be explained later.

The keyboard 17 of the matrix type comprises a series of four keys 17.1, 17.2, 17.3 and 17.4 provided for setting the sewing parameters. In particular, by the key 17.1 the datum bight mangitude of the needle bar 15 is set. By the key 17.2 the datum stroke-length of the feeding device is set. By the key 17.3 the datum pattern length, in the case in which the current pattern is of the satin type or the sum of the patterns is composed by patterns of the satin type, while, in the opposite case, with the key 17.3 the one balance datum is set, considered as an offset value which is added to the stroke-length value of the feeding device. With the key 17.4 the speed datum of the motor MOT is set.

The keyboard 17 comprises moreover a series of numerical keys 17.5 by which it is possible to select a certain number of patterns, everyone of which is characterized by a certain sequence of figures, and two keys 17.6 by which it is possible to select, with step by step scanning, letter-shaped patterns, number-shaped patterns and patterns having the shape of other characters. There are moreover provided two data sliding keys 17.7 and 17.8 and three operative keys 17.9, 17.10 and 17.11 whose functions will be explained later.

By the described sewing maching 10 it is possible to compose, to store and to execute one or more series of patterns, as well as to modify or to correct, to input or to remove one or more patterns of the same pattern series. The microprocessor 19 coordinates, controls and drives all the above mentioned operations, according to the scheme of FIG. 3.

The EPROM memory unit contains the program to be executed by the microprocessor 19. The ROM memory unit contains the data corresponding to the patterns selectable by the keys 17.5 and 17.6.

Figure 4:
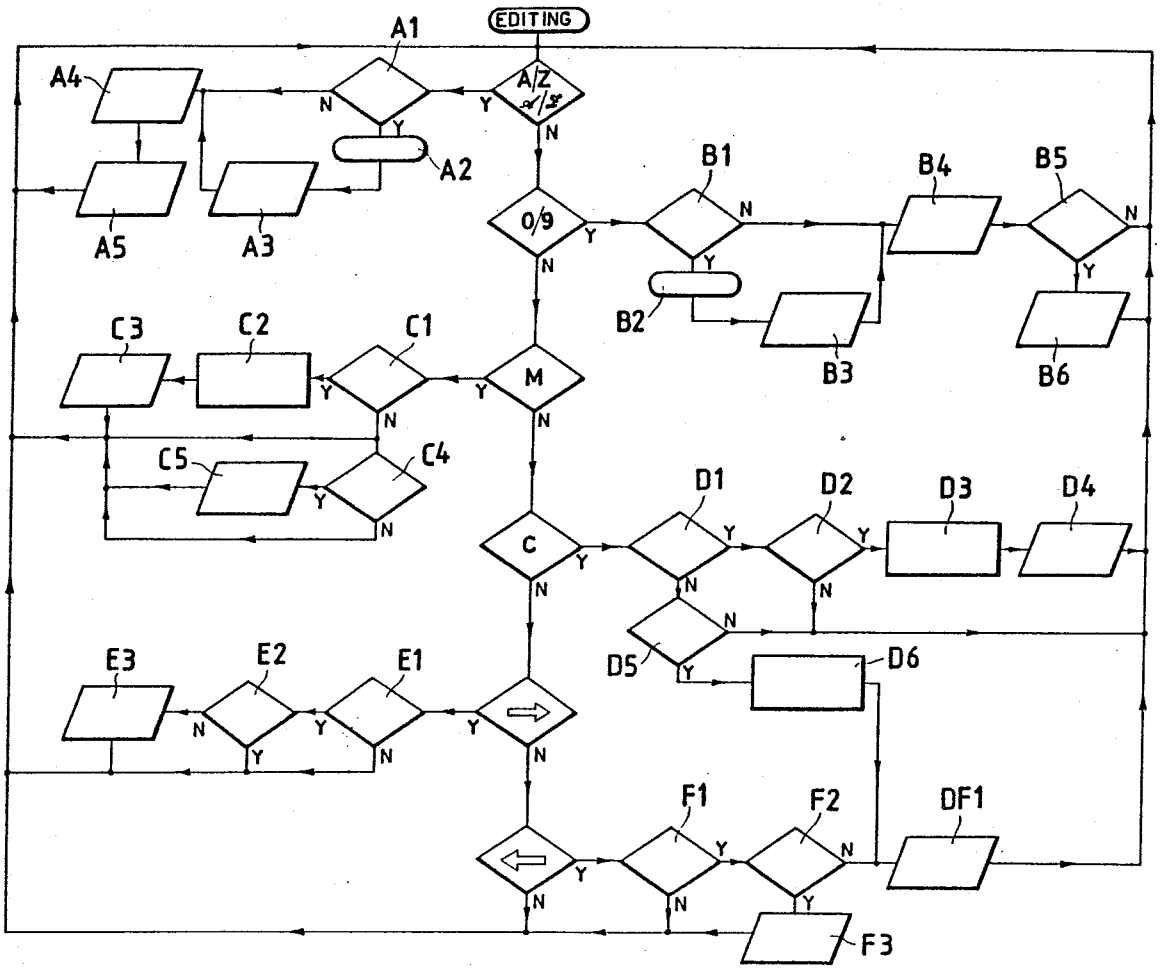
FIG. 4 is a flow chart of an operative logic of the sewing machine of FIG. 1.

The RAM memory unit is provided for containing the data corresponding to the pattern sums and the corresponding parameters, even if the feeding electric tension of the machine 10 is lacking. The programmable logic network PLA is used to assign defined address fields to the various circuit elements which are connected to the address bus AB of the microprocessor 19 (the data bus of the microprocessor is, on the contrary, indicated with DB). In FIG. 4 a flow chart is illustrated of the operative logic of the machine 10 in relation to the above mentioned operations (save the one relative to the execution of the pattern series), defined EDITING. Some decisional blocks of FIG. 4 expressly refer to the keys 17.5, 17.6, 17.7, 17.8, 17.9 and 17.10 of the keyboard 17. All of the other blocks in the figure are blank and each of them is indicated with a letter followed by a number.

The meaning of the blank blocks is hereinafter mentioned:

A1—is the pattern present in the display 18?
A2—input;
A3—free and operative superior zone by left translation, equal to size of a pattern, of the pattern series, along the superior zones of the display 18;
A4—display character in the operative superior zone 18.1;
A5—display pattern parameters in the lower zone 18.3;
B1—is the pattern present on the display 18:
B2—input;
B3—free and operative superior zone 18.1 by left translation equal to the size of a pattern, of the pattern series, along the superior zones of the display 18;
B4—display figure in the operative superior zone 18.1;
B5—third figure pattern code?
B6—display pattern parameters in the lower zone 18.3:
C1—is pattern code correct in the operative superior zone 18.1?
C2—carry pattern code to the left of the operative superior zone 18.1;
C3—display the pattern series starting from the right of the entered one;
C4—is pattern series code existing in the memory?
C5—display the pattern series in the superior zones of the display 18;
D1—pattern series code in the operative superior zone 18.1?
D2—is pattern series present in the superior zones of the display 18?
D3—erase pattern series from the memory;
D4—display 18 reset;
D5—is pattern series present in the superior zones of the display 18?
D6—erase pattern at present in the operative superior zone 18.1;
E1—is pattern series present in the superior zones of the display 18?
E2—first pattern in the operative superior zone 18.1?
E3—translate to the right, with size equal to a pattern, the pattern series along the superior zones of the display 18;
F1—is pattern series present in the superior zones of the display 18:
F2—last pattern in the operative superior zone 18.1?
F3—free the operative superior zone 18.1 by translation to the left, equal to the size of a pattern, of the pattern series along the superior zones of the display 18;
DF1—translate to the left, with size equal to a pattern, the pattern series along the superior zones of the display 18.

The meaning of the letters Y and N at the outputs of the decisional blocks is respectively "Yes" and "No", i.e. in the case of an affirmative answer to the questioning contained in the decisional block the output marked by the letter Y is reached and, to the contrary, in the case of a negative answer the output marked by the letter N is reached.

The operation of the sewing machine 10 with reference to the above mentioned flow chart is described hereinafter. The patterns selectable by the described keyboard 17 are divided, as already said, into two categories: normal and alphanumeric. The normal patterns are all those patterns, simple or of the satin type, which employ simple or fantasy stitches. They are identified by a three figure number, composed by the keys 17.5. The alphanumeric patterns comprise alphabetic patterns, numerical patterns and other variously shaped patterns. They are selected by the two keys 17.6.

For storing a pattern series, utilizing the display 18 reset, the following operations are executed. A normal or an alphanumeric pattern is set by the keys 17.5 or 17.6. In correspondence, to the operative superior zone 18.1 of the display 18, which may display up to three characters, it appears either as a three figure number or an alphanumeric character.

At the moment of the setting of the third figure for the normal pattern or at the moment of the release of the scanning key 17.6 for the alphanumeric pattern, in the area 18.3 of the display 18 for the sewing parameters appear, which may be modified acting on the keys 17.1, 17.2, 17.3 and 17.4.

When the desired pattern and the corresponding parameters are set, they may be stored in the RAM memory simply by pressing key 17.9. The pressing of the key 17.9 causes also the sliding of the three figure number or of the alphanumeric character toward the left from the operative superior zone 18.1 to the consecutive superior zone 18.2

The second pattern of the pattern series and the corresponding parameters are set and displayed at the same time; pressing then the key 17.9 the second pattern and the corresponding parameters add to the first pattern in the RAM memory unit and the sliding towards the left of the characters corresponding to these two first patterns occurs and, as a consequence, the superior operative zone 18.1 gets clear. In this way the same procedure is kept for the subsequent patterns of the pattern series. The pattern series with the corresponding parameters may be memorized and identified by pressing the key 17.11. This operation involves, in particular, the automatic assignment, the storing and the displaying in the superior operative zone 18.1, of a three figure number adapted to identify the pattern series in question. Proceeding in this way, more pattern series may be memorized. In order to recover one of them it is sufficient to compose its identification code by means of the keys 17.5, which will be displayed in the superior operative zone 18.1, and then to press the key 17.9.

Once the pattern series has been recovered from the RAM memory unit, pressing a foot slider of the sewing machine 10, not illustrated, will execute the pattern series, which will be displayed little by little, from the right towards the left in the superior zones 18.1 and 18.2. The pattern to be executed and its parameters will be displayed respectively in the superior operative zone 18.1 and in the inferior zone 18.3.

For modifying, correcting, inputting or taking off one or more patterns of the pattern series, the keyboard is operated in the following way. In the case of modification, correction or erasing, the pattern characters on which there has to be an operation, are carried to the superior operative zone 18.1 and the corresponding parameters in the inferior zone 18.3, by acting on the keys 17.7 and 17.8 which cause the shifting, respectively to the left and to the right, along the superior zones of the display 18, of the series of characters corresponding to the pattern series, and the appearance little by little in the inferior zone 18.3 of the parameters of the patterns which appear in the superior operative zone 18.1.

By acting on the key 17.10 the pattern in question and the corresponding parameters are erased from the pattern series. The modification or the correction of the pattern in question involve simply the resetting of the pattern and of the corresponding parameters in the above described way. Pressing, in fact, the key 17.10 determines the translation in the superior operative zone 18.1 of the character or the characters corresponding to the pattern on the right of the erased one and pressing subsequently one of the keys 17.5, 17.6 causes the retranslation to the right of the character or characters and the clearing of the superior operative zone 18.1, operating then as in a normal setting and storing of a pattern with the corresponding parameters.

In the case of inputting the keyboard is operated in a similar way with the difference that it is not necessary to effect any clearing; it is sufficient, in fact, to cause the character or the characters corresponding to the pattern on the left of which the inputting has to be effected to translate into the superior operative zone 18.1 and then to operate the normal setting and storing of the pattern and the corresponding parameters. During the operation on the pattern in question displayed in the superior operative zone 18.1, the remaining patterns, partially or totally displayed in the superior zone 18.2, and the corresponding parameters remain stored in the RAM memory unit. From what is above described it appears clearly how simple and fast, with the sewing machine, are the operations of modifications, correction, inputting or clearing of a pattern of a pattern series already composed and stored. In fact for these operations it is not necessary to erase and then to reset and to store again a part of the patterns of the pattern series with the corresponding parameters, as in the known art.

Moreover, the superior zones 18.1 and 18.2 permit a vision of the partial or total pattern series, according to the length of the series itself, and the inferior zone 18.3 permits, in the meanwhile, a vision of the corresponding parameters, facilitating to the operator the above mentioned operations, besides the normal operation of setting up and storing of the pattern series with the corresponding parameters.

The keyboard 17 comprises other keys. A key 17.12 permits modifying the parameters of a pattern series retrieved or present on the display 18. Pressing the key 17.12 and acting afterwards on the keys 17.1, 17.2, 17.3, 17.4 four sewing parameters are selected. Thus, pressing the storing key 17.9 these parameters will be memorized and they will be the new, unique parameters of the whole pattern series. If the storing key 17.9 is not pressed, the modification acts on the patterns of the pattern series which have to be still executed by the machine (i.e. the pattern which is in the superior operative zone 18.1 and the subsequent patterns). Substantially the key 17.12 causes the exchange of the various parameters of the pattern series displayed in the areas 18.1 and 18.2 with the parameters displayed in the zone 18.3.

A key 17.13 permits the operator to create new patterns besides the already stored ones. When the key 17.13 is pressed, acting on the numeric keys 17.5, they are composed with displaying in the superior area 18.1 and 18.2, the coordinates of the stitches of the new pattern, i.e. the work feed coordinates and the needle bar bight magnitude coordinates. In a similar way with respect to the pattern series, the keys 17.7 and 17.8 will permit the sequence of the stitches coordinates of the new pattern to move back and forth. The key 17.10 will permit the clearing of the stitches coordinates present on the display 18. The key 17.11 will permit the automatic codification of the new pattern by means of three numbers which will appear in the superior operative area 18.1. By means of the keys 17.1, 17.2, 17.3, 17.4 the sewing parameters of the new pattern will be set, and, at last, by means of the key 17.9 all this will be stored in the RAM memory unit.

A series of four keys is then provided, each one with a LED indicator which turns on when the key is activated. Precisely, a key 17.14 permits arranging the positioning or the stop of the needle 15A in the upper position (non activated key) or in the lower position (activated key). A key 17.15 permits selecting the sewing with a twin needle, causing the automatic reduction of the needle bar bight. A key 17.16 permits selecting the sewing, specular with respect to the work feeding axis, of the pattern or of the set pattern series; and a key 17.17 permits selecting the stop of the machine at the end of a pattern or of the pattern series. There are finally provided: a restarting key 17.18 which permits interrupting and restarting the sewing without any alteration of the pattern, as well as, considering a determined displayed pattern series, to start from the pattern present in the superior operative zone 18.1; a key 17.19, by the pressing of which, a series of information is given to the operator, displayed in the area 18.3, corresponding to the manual operations to be effected on the machine in order to obtain a better result of sewing of the selected pattern; and two keys 17.20 and 17.21 for the direct selection of the straight pattern and of the zog-zag pattern respectively.

To the described keyboard 17, there is also operatively connected, through the microprocessor 19, a buzzer 20, schematized in FIG. 3, whose function is to give acustic signals to the operator in case of wrong operations or to give an acustic indication of the effected pressing of a key. The microprocessor 19 is not here described in its details either in its section "hardware" or in its section "software", as a skilled person in the art is able to find on the market and to program a microprocessor component adapted to coordinate, to control and to command all the above mentioned operations. The keyboard 17 and the display 18 are particularly compact permitting nevertheless the operator to executed sophisticated operations in comparison with the operations performable by the common sewing machines. The compactness of a control board is a fundamental feature in the planning of the sewing machines, as the space at disposal on the casing of the machine is necessarily limited, because of the existence of encumbrances on the machine itself. It is to be outlined that compactness and high performances are not prejudicial to the operative simplicity of the machine, as it may be understood from what has been described.

It also has to be noted the convenient disposition of the setting keys of the sewing parameters, each of which is in correspondance with the portions of the zone 18.3 where the corresponding sewing parameter is displayed in such a way that the operator may control constantly the pattern and the corresponding sewing parameters. Also the keys 17.7 and 17.8 marked by an arrow, bordering the display 18, give to the operator the immediate perception of the effect of the data translation along the superior zones 18.1 and 18.2, caused by their manipulation.

It is obviously possible to effect variations to what has been described and illustrated. In particular, the number of characters which compose the display 18 may be varied, considering, of course, the existence of compactness, in such a way that, for example, the operative zone of the display may have a larger or a smaller number of characters and similarly for the other zones of the display. It is not necessary that the display is of the liquid crystal type, it may be also of the LED type or another.

Also the disposition and the number of keys of the keyboard may be varied, remaining steady the keys for the data setting and for the modification, correction, inputting and erasing of the same.

The described sewing machine may provide structurally a base for the application of one or more additional, extractable and/or interchangeable memories, represented in FIG. 3 with blocks in dotted lines, marked by the letter ME, and drafted to contain data of further patterns already set by the manufacturer or set by the user, for amplifying the performances of the machine itself.

It is also possible not to use the RAM memory unit for the pattern set by the user, but to use for them exclusively such additional memories.

We claim:

1. An electronic sewing machine comprising a keyboard, a display unit, a microprocessor unit connected to said keyboard, to said display unit, to a first memory unit containing data corresponding to a pattern series, and to a second memory unit for storing data of patterns displayed in said display unit, enabling modification of parameters of each pattern and pattern series at the same time while displayed, said keyboard comprising keys for recovering on the display unit the alphanumeric type shaped patterns contained in said first memory unit, keys for setting the sewing parameters of the recovered patterns, a key for storing in said second memory unit the recovered patterns and the corresponding sewing parameters, said display unit comprising a first zone and a second zone along which the series of the set patterns slides and a third zone in which said sewing parameters are displayed, said first zone being moreover provided for displaying the pattern to be set, the pattern in phase of sewing, and the pattern on which operations are to be effected, the parameters of the pattern displayed in said first zone being in the meantime displayed in said third zone, the remaining patterns of the pattern series being displayed in said second zone, said remaining patterns and corresponding parameters persisting in said second memory during the operations to be effected on the above mentioned pattern.

2. The sewing machine according to claim 1, wherein said keyboard comprises moreover a codification key for automatically assigning, storing and displaying in said first zone an identification code of a pattern series and corresponding sewing parameters set on such display.

3. The sewing machine according to claim 1, wherein said keyboard comprises further a key for the erasing of the pattern displayed in said first zone and of the corresponding sewing parameters displayed in said third zone.

4. The sewing machine according to claim 1, wherein said keyboard comprises moreover at least a key for the sliding of the patterns along said first and second zones.

5. The sewing machine according to claim 4, wherein said keyboard comprises a couple of keys for the sliding respectively in one direction and in the opposite direction of the patterns along said first and second zones.

6. The sewing machine according to claim 1, wherein said keyboard comprises a key for the exchange of the various parameters of the patterns series displayed in said first and second zones with the parameters displayed in said third zone.

7. The sewing machine according to claim 1, wherein said keyboard comprises moreover a key for the communication of the machine into state of creation of new patterns, keys being provided for the setting, in said creative state, of the coordinates of the above mentioned new patterns, said first and second zones displaying, in said creative state, the above mentioned coordinates.

8. The sewing machine according to claim 7, wherein said keys for the setting of the coordinates of new patterns are formed by a series of numeric keys comprised in said keys for the covering of the stored patterns.

9. The sewing machine according to claim 7, wherein said keyboard comprises moreover a codification key for automatically assigning, storing and displaying in said first zone an identification code of the newly created pattern, said third zone displaying the sewing parameters of the above mentioned newly created pattern, modifiable by means of said keys for the setting of the sewing parameters.

10. The sewing machine according to claim 9, wherein, when the machine is not in said creative state, said codification key of the new set pattern has the function of a codification key for automatically assigning, storing and displaying in said first zone an identification code of a pattern series and of the corresponding sewing parameters set on said display.

11. The sewing machine according to claim 1, wherein each of said keys for the setting of the sewing parameters is placed in correspondence with a portion of the above mentioned third zone in which the corresponding sewing parameter is displayed.

12. The sewing machine according to claim 4, wherein at least one of said keys for the sliding of the patterns is placed in correspondence with said first and second zones.

13. The sewing machine according to claim 12, wherein at least one of said keys for the sliding of the patterns is placed consecutively to said first and second zones.

14. The sewing machine according to claim 1, wherein said keys for the recovery on the display of the stored patterns comprise a series of numeric keys and at least a key for the step by step scanning of a series of characters.

15. The sewing machine according to claim 2, wherein at least some of said keys for the recovery of the stored patterns on the display also provide for the recovery of the above mentioned identification code of a series of patterns in said first zone.

16. The sewing machine according to claim 15, wherein said storing keys also provide for recovering in said first and second zones the series of patterns corresponding to the identification code displayed in said first zone.

17. The sewing machine according to claim 1, wherein there is provided at least an additional extractable memory comprising further data corresponding to a further pattern series.

18. The sewing machine according to claim 7, wherein the data corresponding to said set new patterns are stored in said second memory.

19. The sewing machine according to claim 18, wherein at least an additional, extractable memory is provided adapted to contain further data corresponding to further new set patterns.

20. The sewing machine according to claim 7, wherein at least an additional extractable memory is provided, adapted to contain the data corresponding to said new set patterns.

* * * * *